US011849810B2

(12) United States Patent
Chen

(10) Patent No.: US 11,849,810 B2
(45) Date of Patent: Dec. 26, 2023

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 0 days.

(21) Appl. No.: 17/662,076

(22) Filed: May 5, 2022

(65) Prior Publication Data

US 2023/0056011 A1 Feb. 23, 2023

(30) Foreign Application Priority Data

Aug. 18, 2021 (TW) ..... 110209782

(51) Int. Cl.
*A43C 11/16* (2006.01)

(52) U.S. Cl.
CPC ..... *A43C 11/16* (2013.01)

(58) Field of Classification Search
CPC ..... A43C 11/16; A43C 11/165
See application file for complete search history.

(56) References Cited

U.S. PATENT DOCUMENTS 4,633,599 A * 1/1987 Morell ..... A43C 11/16 242/389
5,606,778 A * 3/1997 Jungkind ..... A43C 11/165 24/68 SK
2005/0247813 A1* 11/2005 Kovacevich ..... A42B 3/08 242/395
2007/0084956 A1* 4/2007 Chen ..... A43C 7/00 242/388.6
2009/0211385 A1* 8/2009 Fiquepron ..... A43C 11/16 74/422
2010/0139057 A1* 6/2010 Soderberg ..... A61F 5/0118 242/396.2
2010/0251524 A1* 10/2010 Chen ..... A43C 11/165 24/713.2
2011/0191992 A1* 8/2011 Chen ..... A43C 11/008 24/713.2
2016/0198801 A1 7/2016 Kim et al.
2016/0213099 A1* 7/2016 Ha ..... A43C 11/20
2016/0262496 A1* 9/2016 Midorikawa ..... A43C 11/165
2017/0027287 A1* 2/2017 Burns ..... A61F 5/0118
2017/0042289 A1* 2/2017 Ha ..... A44B 99/00
2017/0202315 A1* 7/2017 Chen ..... A43C 1/00
2017/0224056 A1* 8/2017 Midorikawa ..... A43C 11/165
2017/0295888 A1* 10/2017 Chen ..... A43C 11/165
2017/0303643 A1* 10/2017 Converse ..... A61C 7/026
2017/0325548 A1* 11/2017 Ha ..... A43C 11/165
2019/0174872 A1* 6/2019 Kawano ..... B65H 75/38
2020/0205523 A1* 7/2020 Kawano ..... A44B 11/12

(Continued)

FOREIGN PATENT DOCUMENTS

WO 2016114568 A1 7/2016
WO 2016114569 A1 7/2016

*Primary Examiner* — David M Upchurch
(74) *Attorney, Agent, or Firm* — CKC & Partners Co., LLC

(57) ABSTRACT

A fastening device includes a case unit including a receiving space, a spool located within the receiving space and configured for a lace to be wound therearound, and a knob covering on the case unit. The knob includes a main body and an outer annular portion surrounding the main body. The main body includes a top portion, and the top portion is made of a composite material. The outer annular portion is made of a metal material. A rotation of the knob drives the spool to rotate in a tightening direction for tensioning the lace.

12 Claims, 5 Drawing Sheets

(56) References Cited

U.S. PATENT DOCUMENTS

| | | | | |
|---|---|---|---|---|
| 2020/0268108 | A1* | 8/2020 | Fiedler | A45C 13/1069 |
| 2021/0037926 | A1* | 2/2021 | Kim | A43C 7/08 |
| 2021/0227937 | A1* | 7/2021 | Hu | A43C 7/08 |
| 2021/0401121 | A1* | 12/2021 | Kim | A41F 1/00 |

* cited by examiner

FASTENING DEVICE

RELATED APPLICATIONS

This application claims priority to Taiwan Application Serial Number 110209782, filed Aug. 18, 2021, which is herein incorporated by reference.

BACKGROUND

Technical Field

The present disclosure relates to a fastening device. More particularly, the present disclosure relates to a fastening device for securing an article through loosening or tensioning a lace.

Description of Related Art

In daily life, cords, such as a lace or a thread, are usually used to tighten articles. The most common tightening method is to use the cord to reciprocately pass through holes on the article, e.g., eyelets of a shoe, and then tie a knot to secure the article. But in this kind of tightening method, the knot is loosened easily owing to an external force. Not only does the knot need to be tied again, but also lots of inconveniences come owing to the insecurity of the articles.

In order to solve such problems, some practitioners developed a simple fastening mechanism including a case, an engaging unit and a spring. The case includes holes configured for the lace to pass therethrough. Through the reaction force between the spring and the engaging unit, the lace can be clamped between the engaging unit and the case so as to be fastened. The length of the lace can be changed by pressing the spring to change the position of the engaging unit. However, in such fastening mechanism, the restoring force of the spring is served as the securing force; thus, the lace is easily to be released owing to vibrations or an external force. In addition, the fastening mechanism has no space for receiving the lace, and the exposure of the lace may bring danger.

Therefore, some practitioners developed another kind of buckle which can be rotated to tension the lace, and the lace can be received inside the buckle. Through the interference between components inside the buckle, the length of the lace as well as the tightness can be adjusted. However, the structure of the buckle generally includes a case and a knob made of a metal material, which is heavy and has a high cost.

Based on the above-mentioned problems, how to solve the problems becomes a pursued target for practitioners.

SUMMARY

According to one aspect of the present disclosure, a fastening device includes a case unit including a receiving space, a spool located within the receiving space and configured for a lace to be wound therearound, and a knob covering on the case unit. The knob includes a main body and an outer annular portion surrounding the main body. The main body includes a top portion, and the top portion is made of a composite material. The outer annular portion is made of a metal material. A rotation of the knob drives the spool to rotate in a tightening direction for tensioning the lace.

According to another aspect of the present disclosure, a fastening device includes a case unit including a receiving space, a spool located within the receiving space and configured for a lace to be wound therearound, an engaging unit located above the spool, and a knob covering on the case unit. The knob includes a main body and an outer annular portion surrounding the main body. The main body includes a top portion, and the top portion is made of a carbon-fiber composite material. The outer annular portion is made of a metal material. An operation of the knob allows the engaging unit to be positioned in a first position or a second position along an axial direction, and when the engaging unit is in the first position, a rotation of the knob drives the spool to rotate in a tightening direction for tensioning the lace.

BRIEF DESCRIPTION OF THE DRAWINGS

The disclosure can be more fully understood by reading the following detailed description of the embodiments, with reference made to the accompanying drawings as follows.

DETAILED DESCRIPTION

It will be understood that when an element (or mechanism or module) is referred to as being "disposed on", "connected to" or "coupled to" another element, it can be directly disposed on, connected or coupled to the other element, or intervening elements may also be present. In contrast, when an element is referred to as being "directly disposed on", "directly connected to" or "directly coupled to" another element, there are no intervening elements present.

In addition, the terms first, second, third, etc. are used herein to describe various elements or components, these elements or components should not be limited by these terms. Consequently, a first element or component discussed below could be termed a second element or component.

Figure 1:
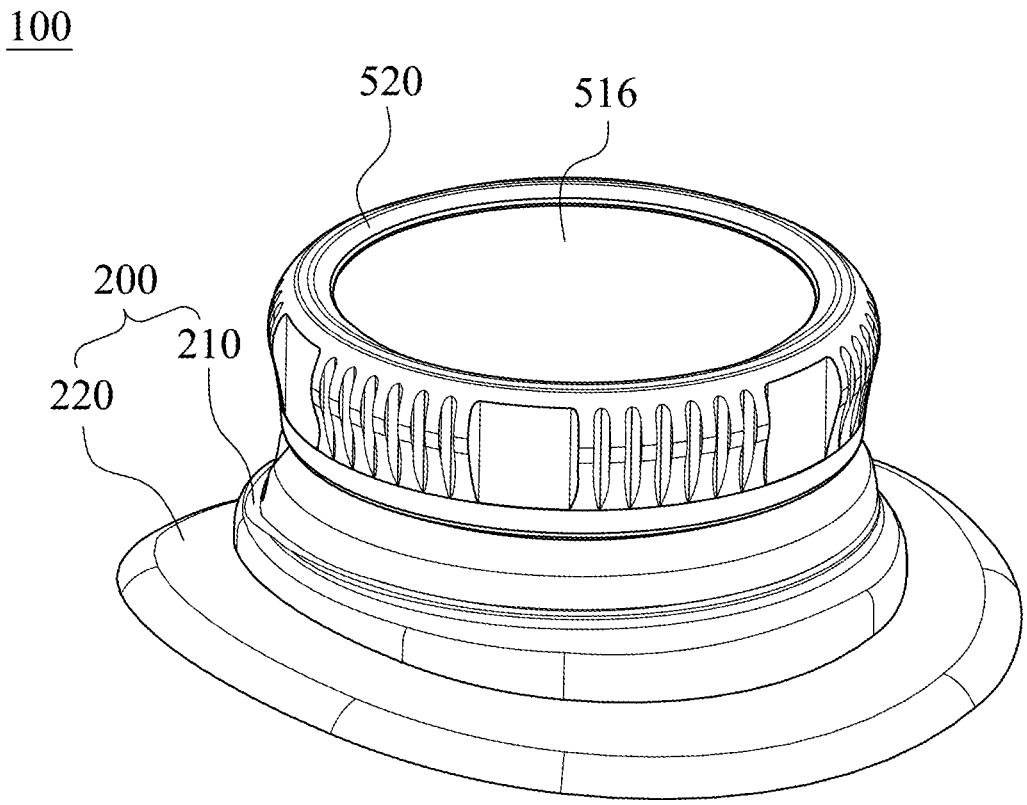
FIG. 1 shows a three dimensional schematic view of a fastening device according to one embodiment of the present disclosure.
Figure 2:
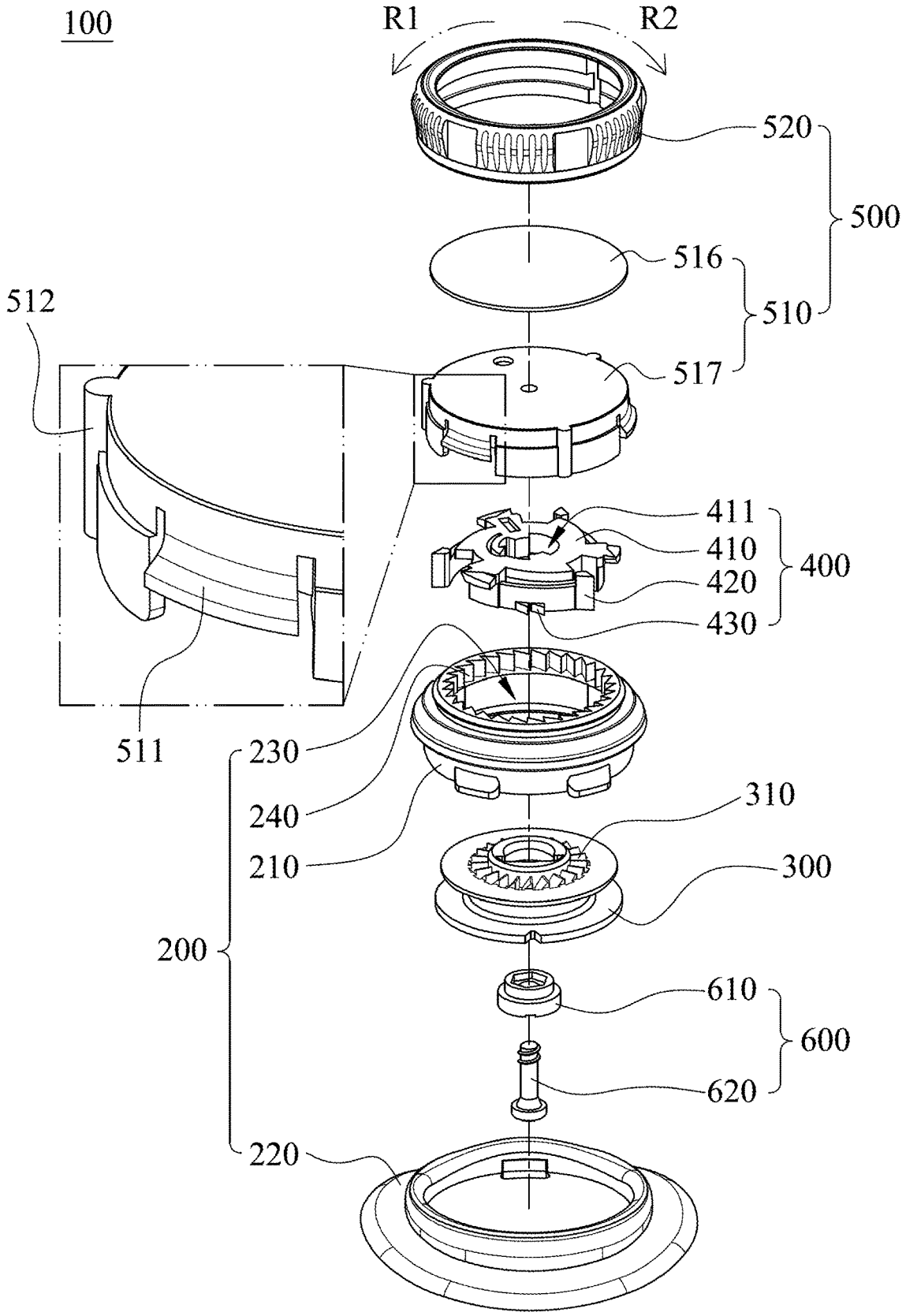
FIG. 2 shows one exploded view of the fastening device of FIG. 1.
Figure 3:
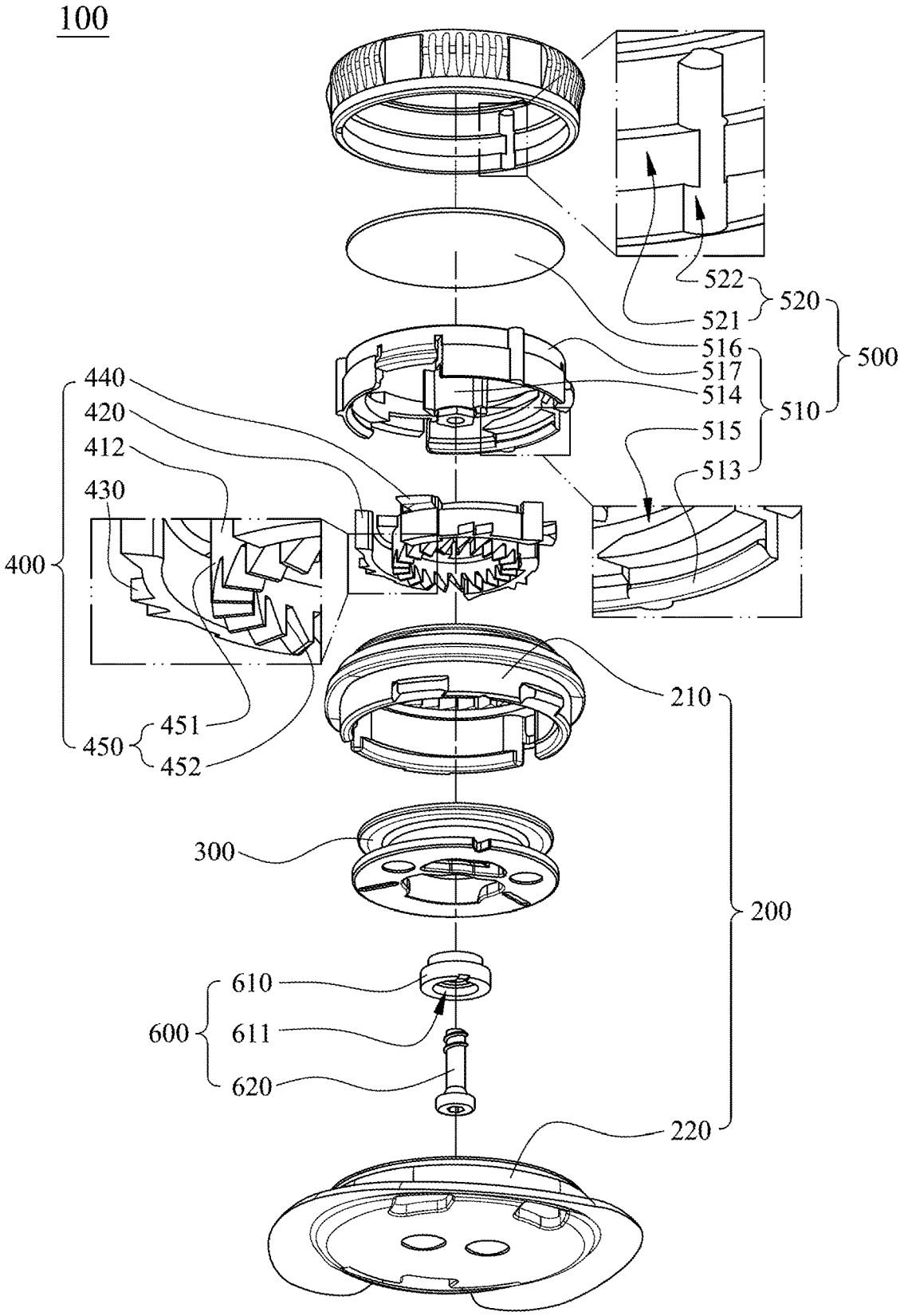
FIG. 3 shows another exploded view of the fastening device of FIG. 1.

FIG. 1 shows a three dimensional schematic view of a fastening device 100 according to one embodiment of the present disclosure. FIG. 2 shows one exploded view of the fastening device 100 of FIG. 1. FIG. 3 shows another exploded view of the fastening device 100 of FIG. 1. As shown in FIG. 1 to FIG. 3, the fastening device 100 includes a case unit 200 including a receiving space 230, a spool 300 located within the receiving space 230 and configured for a lace (not shown) to be wound therearound, and a knob 500 covering on the case unit 200. The knob 500 includes a main body 510 and an outer annular portion 520 surrounding the main body 510. The main body 510 includes a top portion 516, and the top portion 516 is made of a composite material. The outer annular portion 520 is made of a metal material. A rotation of the knob 500 drives the spool 300 to rotate in a tightening direction R2 for tensioning the lace.

Therefore, through the configuration that the knob 500 includes the outer annular portion 520 and the main body 510, and the outer annular portion 520 is made of a metal material while the main body 510 is made of other materials, the weight as well as the cost can be reduced while the structural strength is remained. The details of the fastening device 100 will be described hereinafter.

The case unit 200 of the fastening device 100 can include an annular wall 210, a base 220 and a plurality of mounting teeth 240. The annular wall 210 defines the receiving space 230 and includes an upper opening (not labeled) and a lower opening (not labeled). The base 220 is detachably connected to the annular wall 210 to close the lower opening. The mounting teeth 240 are located at the annular wall 210 and face toward the receiving space 230.

The case unit 200 can further include a snapping portion 250 (shown in FIG. 4), the main body 510 can further include a coupling portion 513, and the snapping portion 250 is coupled to the coupling portion 513 to connect the main body 510 to the case unit 200. The snapping portion 250 is located at an upper end of the annular wall 210 and has a groove structure. The coupling portion 513 is located at a lower end of the inner surface of the main body 510, and has a protrusion structure. Consequently, the snapping portion 250 can be coupled to the coupling portion 513 via a snap-fit engagement, and the main body 510 can cover on the annular wall 210 to close the upper opening.

The material of the outer annular portion 520 can be, for example, aluminum, copper, zinc or the alloy thereof, which can have an advantage of light weight. The composite material of the top portion 516 can be, for example, a carbon-fiber composite material, which can have advantages of light weight and high strength. In addition, the main body 510 can further include a cover portion 517 located between the case unit 200 and the top portion 516, and the cover portion 517 is made of plastic. In the present embodiment, although the cover portion 517 is illustrated as being separated from the top portion 516, in other embodiments, the cover portion and the top portion can be formed integrally using the dual-injecting process to allow the main body to be a one-piece element having different materials. The materials of the top portion and the cover portion are not limited to the above, and other non-metal materials or other composite materials can be used. The outer annular portion can also be made of other metal materials, and the present disclosure is not limited thereto.

The outer annular portion 520 can include an upper restricting portion 523 (shown in FIG. 4) protruding inwardly from an upper edge of the outer annular portion 520 and being ring-shaped, and the top portion 516 is abutted between the upper restricting portion 523 and the cover portion 517. A thickness of the top portion 516 is uniform, and a distance D1 (shown in FIG. 4) between an upper surface of the top portion 516 and the upper edge of the outer annular portion 520 is larger than zero. In other words, as the top portion 516 and the cover portion 517 are assembled inside the outer annular portion 520, the top portion 516 is lower than the upper edge of the outer annular portion 520.

Moreover, the main body 510 can further include at least one radial protrusion 511, the outer annular portion 520 can further include at least one radial groove 521, and the at least one radial protrusion 511 is received in the at least one radial groove 521. In addition, the main body 510 can further include at least one axial rib 512, the outer annular portion 520 can further include at least one axial slot 522, and the at least one axial rib 512 is received in the at least one axial slot 522.

To be more specific, a number of the radial protrusions 511 and a number of the axial ribs 512 are both three. Each of the three radial protrusions 511 is staggered from each of the three axial ribs 512 and is arranged on the outer surface of the cover portion 517. A number of the axial slots 522 is three and the axial slots 522 are located at an inner surface of the outer annular portion 520. The inner surface of the outer annular portion 520 can be depressed to form an inner annular groove, and the three axial slots 522 are communicated with the inner annular groove and split the inner annular groove into three segments to form the three radial grooves 521 for cooperating with the three radial protrusions 511.

Hence, the three radial protrusions 511 are associated with the three radial grooves 521 to assemble the main body 510 and the outer annular portion 520. The cooperation between the axial rib 512 and the axial slot 522 can prevent rotation between the outer annular portion 520 and the cover portion 517, and can be favorable for transferring the operating force of the user. Furthermore, the outer annular portion 520 can include a plurality of anti-slip strips (not labeled) to increase the friction between the outer annular portion 520 and the user.

The fastening device 100 can further include an engaging unit 400 located above the spool 300. An operation of the knob 500 allows the engaging unit 400 to be positioned in a first position or a second position along an axial direction 11 (shown in FIG. 4), and when the engaging unit 400 is in the first position, a rotation of the knob 500 drives the spool 300 to rotate in the tightening direction R2 for tensioning the lace. As the engaging unit 400 is located in the second position, the spool 300 is allowed to release the lace.

Precisely, the engaging unit 400 can include a ring body 410, three pawl arms 420, three stop portions 430 and three guiding portions 440. The ring body 410 includes a central hole 411 configured for the central post 514 of the main body 510 to insert thereinto. The three pawl arms 420 protrude from the ring body 410 and are spaced apart from each other. The three stop portions 430 are disposed at the three pawl arms 420, respectively. The three guiding portions 440 are configured for cooperated with the spiral track 515 of the main body 510.

The engaging unit 400 can further include a plurality of first combining teeth 450, the spool 300 can include a plurality of second combining teeth 310, and when the engaging unit 400 is located in the first position, the first combining teeth 450 are engaged with the second combining teeth 310. Each of the first combining teeth 450 is formed integrally with the ring body 410 and protrudes toward the spool 300. An outer tooth-facet 451 of each of the first combining teeth 450 is extended downwardly and integrally from an outer surface 412 of the ring body 410. In other words, the distance between two opposite outer tooth-facets 451 is equal to the outer diameter of the outer surface 412. Each of the first combining teeth 450 can further include a first longitudinal facet 452, and the first longitudinal facet 452 is substantially parallel to the axial direction 11. Each of the second combining teeth 310 can include a second longitudinal facet (not labeled) corresponding to the first longitudinal facet 452. When the engaging unit 400 is rotated in the tightening direction R2, the first longitudinal facet 452 pushes the second longitudinal facet of the spool 300, thereby favorable for transferring the rotary force of the engaging unit 400.

Furthermore, the fastening device 100 can further include a connecting unit 600 connected to the main body 510 of the knob 500 and being restricted by the spool 300. Precisely, the connecting unit 600 includes a stop plate 610 and a screw member 620. The stop plate 610 includes a through hole 611. The stop plate 610 inserts the central clearance hole (not labeled) of the spool 300, and the screw member 620 inserts upward into the through hole 611 of the stop plate 610 to fasten with the central post 514, thereby allowing the screw member 620 to be restricted by the stop plate 610 and allowing the stop plate 610 to be restricted by the spool 300.

Figure 4:
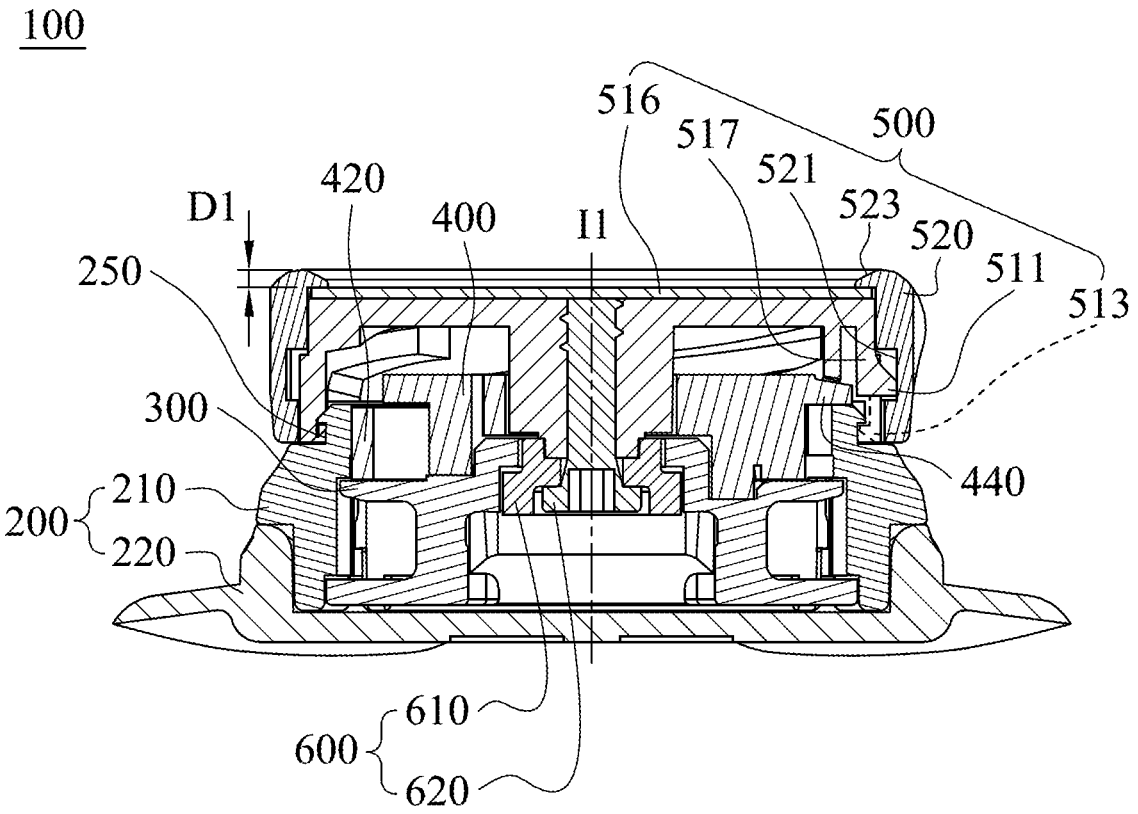
FIG. 4 shows one cross-sectional view of the fastening device of FIG. 1.
Figure 5:
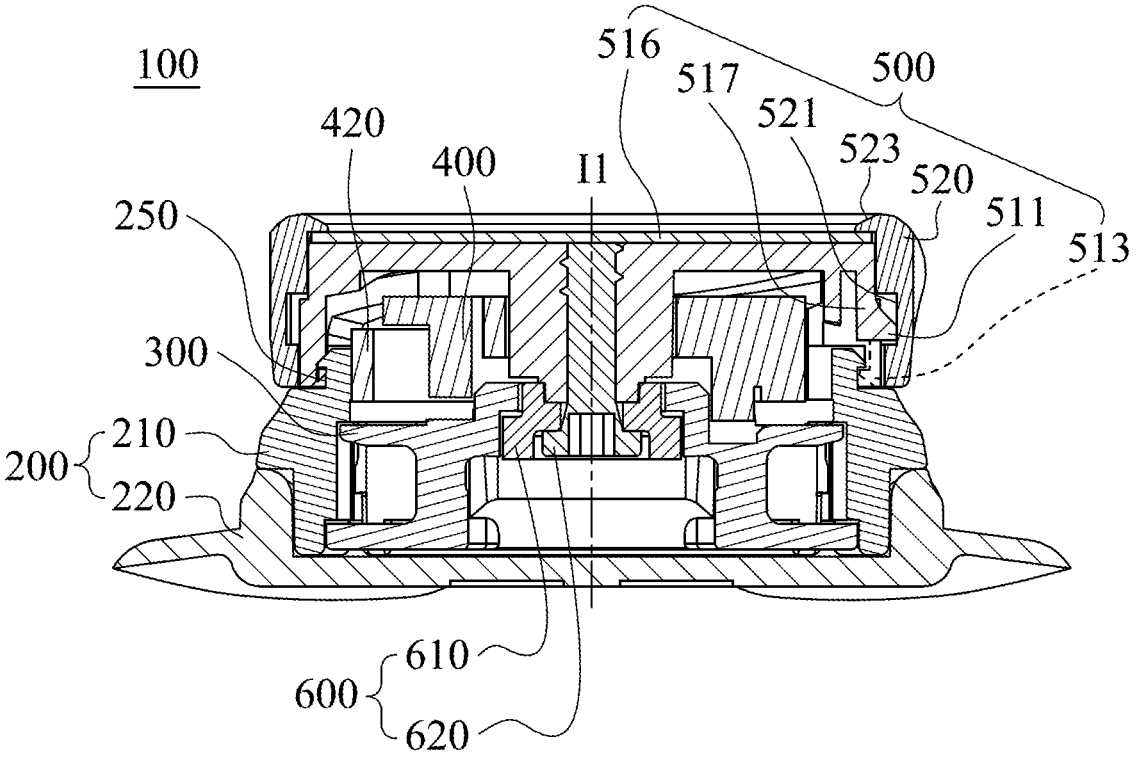
FIG. 5 shows another cross-sectional view of the fastening device of FIG. 1.

FIG. 4 shows one cross-sectional view of the fastening device 100 of FIG. 1. FIG. 5 shows another cross-sectional view of the fastening device 100 of FIG. 1. As shown in FIG. 4, the engaging unit 400 is located in the first position, the first combining teeth 450 of the engaging unit 400 are engaged with the second combining teeth 310 of the spool 300, and the pawl arms 420 are engaged correspondingly with the mounting teeth 240. As the user holds the outer annular portion 520 to rotate the knob 500 in the tightening direction R2, the engaging unit 400 is allowed to be rotated simultaneously, and a distal end of the pawl arm 420 can be disengaged from the mounting teeth 240, thereby allowing the spool 300 to rotate in the tightening direction R2 for tensioning the lace. As the user stops exerting the force, the distal end of the pawl arm 420 is engaged with the mounting teeth 240 to prevent the spool 300 from rotating in the loosening direction R1, and the lace cannot be unwound.

In contrast, as shown in FIG. 5, as the user is looking forward to release the lace, the user can hold the outer annular portion 520 to rotate the knob 500 in the loosening direction R1. Owing to the restriction that the distal end of the pawl arm 420 is engaged with the mounting teeth 240, the engaging unit 400 cannot rotate simultaneously, and the guiding portions 440 are guided by the spiral track 515 to allow the engaging unit 400 to be raised along the axial direction 11 and to be switched to the second position. Thus, the first combining teeth 450 of the engaging unit 400 are disengaged from the second combining teeth 310 of the spool 300, the spool 300 is not restricted, and pulling the lace can rotate the spool 300 in the loosening direction R1, thereby unwinding the lace. Moreover, the distal end of the pawl arm 420 can still be engaged with the mounting teeth 240, and since the first combining teeth 450 are disengaged from the second combining teeth 310 of the spool 300, the engaging unit 400 will not affect the spool 300. Furthermore, as the engaging unit 400 is in the second position, the stop portion 430 can be engaged with the mounting teeth 240, and as the user rotates the knob 500 in the tightening direction R2, the configuration is favorable for the engaging unit 400 to lower to the first position. Please be noted that, the stop portion 430 will not be engaged with the mounting teeth 240 when the engaging unit 400 is in the first position, and rotation of the spool 300 in the tightening direction R2 is not affected.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A fastening device, comprising:
a case unit comprising a receiving space;
a spool located within the receiving space and configured for a lace to be wound therearound; and
a knob covering on the case unit and comprising:
a main body comprising a top portion, wherein the top portion is made of a composite material; and
an outer annular portion surrounding the main body, wherein the outer annular portion is made of a metal material;
wherein a rotation of the knob drives the spool to rotate in a tightening direction for tensioning the lace.

2. The fastening device of claim 1, wherein the main body further comprises at least one radial protrusion, the outer annular portion comprises at least one radial groove, and the at least one radial protrusion is received in the at least one radial groove.

3. The fastening device of claim 1, wherein the main body further comprises at least one axial rib, the outer annular portion comprises at least one axial slot, and the at least one axial rib is received in the at least one axial slot.

4. The fastening device of claim 1, wherein the case unit comprises a snapping portion, the main body further comprises a coupling portion, and the snapping portion is coupled to the coupling portion to connect the main body to the case unit.

5. The fastening device of claim 1, wherein the main body further comprises a cover portion located between the case unit and the top portion, and the cover portion is made of plastic.

6. The fastening device of claim 5, wherein the outer annular portion comprises an upper restricting portion, the upper restricting portion protrudes inwardly from an upper edge of the outer annular portion, the upper restricting portion is ring-shaped, and the top portion is abutted between the upper restricting portion and the cover portion.

7. The fastening device of claim 1, wherein a thickness of the top portion is uniform, and a distance between an upper surface of the top portion and an upper edge of the outer annular portion is larger than zero.

8. A fastening device, comprising:
a case unit comprising a receiving space;
a spool located within the receiving space and configured for a lace to be wound therearound;
an engaging unit located above the spool; and
a knob covering on the case unit and comprising:
a main body comprising a top portion, wherein the top portion is made of a carbon-fiber composite material; and
an outer annular portion surrounding the main body, wherein the outer annular portion is made of a metal material;
wherein an operation of the knob allows the engaging unit to be positioned in a first position or a second position along an axial direction, and when the engaging unit is in the first position, a rotation of the knob drives the spool to rotate in a tightening direction for tensioning the lace.

9. The fastening device of claim 8, wherein the main body further comprises at least one radial protrusion, the outer annular portion comprises at least one radial groove, and the at least one radial protrusion is received in the at least one radial groove.

10. The fastening device of claim 8, wherein the main body further comprises at least one axial rib, the outer annular portion comprises at least one axial slot, and the at least one axial rib is received in the at least one axial slot.

11. The fastening device of claim 8, wherein the main body further comprises a cover portion located between the case unit and the top portion, and the cover portion is made of plastic.

12. The fastening device of claim 11, wherein the outer annular portion comprises an upper restricting portion, the upper restricting portion protrudes inwardly from an upper edge of the outer annular portion, the upper restricting portion is ring-shaped, and the top portion is abutted between the upper restricting portion and the cover portion.

* * * * *